US007290866B2

(12) United States Patent
Sugahara

(10) Patent No.: US 7,290,866 B2
(45) Date of Patent: Nov. 6, 2007

(54) LIQUID DISCHARGING APPARATUS

(75) Inventor: Hiroto Sugahara, Ama-gun (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 418 days.

(21) Appl. No.: 11/088,963

(22) Filed: Mar. 24, 2005

(65) Prior Publication Data

US 2005/0219324 A1 Oct. 6, 2005

(30) Foreign Application Priority Data

Mar. 31, 2004 (JP) ..... 2004-102389

(51) Int. Cl.
*B41J 2/045* (2006.01)

(52) U.S. Cl. ..... 347/68; 347/70; 347/94

(58) Field of Classification Search ..... 347/20, 347/56, 67, 92–94, 68, 70, 71
See application file for complete search history.

(56) References Cited

U.S. PATENT DOCUMENTS 5,402,159 A 3/1995 Takahashi et al. ..... 347/9
5,406,318 A * 4/1995 Moore et al. ..... 347/70

FOREIGN PATENT DOCUMENTS

JP A 04-341852 11/1992
JP A 05-162311 6/1993

* cited by examiner

*Primary Examiner*—Juanita D. Stephens
(74) *Attorney, Agent, or Firm*—Oliff & Berridge, PLC

(57) ABSTRACT

An ink discharging apparatus includes a channel unit and actuators. The channel unit has a manifold and separate ink channels, and includes an actuator plate. The ink channels extend from the manifold, each via a pressure chamber to a nozzle. The actuators are fixed to the channel unit, each of which changes the volume of one of the pressure chambers. Each of the pressure chambers is fitted with a barrier block in its bottom surface. The barrier block crosses the line segment connecting an ink inlet port and an ink outlet port. The barrier block has a height which makes no contact with the actuator plate, which is displaced partially when one or more of the actuators are driven. The ink discharger is low in power consumption and can be manufactured at low cost.

28 Claims, 10 Drawing Sheets

LIQUID DISCHARGING APPARATUS

FIELD OF THE INVENTION

The present invention relates to the liquid discharging apparatus such as an ink jet printer capable of discharging a liquid.

BACKGROUND OF THE INVENTION

An ink jet printer is equipped with an ink jet head that forms desired dots on printing paper by discharging ink from its nozzles toward the paper. For example, FIG. 1 of Japanese Patent Application Laid-open No. 04-341852 corresponding to U.S. Pat. No. 5,402,159 shows such an ink jet head which is provided with ink channels and actuators. The ink channels extend from a manifold, which holds ink, each via a pressure chamber to a nozzle. Each of the actuators develops pressure in one of the pressure chambers by changing the volume of the chamber. Since the ink channels are filled with ink supplied from the manifold, the development of pressure in the pressure chambers causes pressure waves through the medium of the ink in the ink channels, and the pressure waves propagate through the pressure chambers. The pressure developed in the pressure chambers raises the pressure near the nozzles, and the discharge of ink begins. When negative pressure waves propagating from the manifold reach the vicinities of the nozzles, the pressure near the nozzles falls, and the ink discharge ceases.

In order to attain the desired print concentration, ink droplets having the predetermined volume must be discharged from the nozzles. The volume of an ink droplet discharged from a nozzle depends on the area of the nozzle opening, the speed at which the ink droplet is discharged from the nozzle, and AL (acoustic length) that is the length of time for a pressure wave to propagate from the manifold to the nozzle. In order to discharge ink droplets of the predetermined volume, it is conceivable to enlarge the area of the nozzle opening, raise the discharge speed of the ink droplets, or increase the AL. However, enlarging the opening area increases the driving voltage required for discharging the ink droplets, leading to the problem of greater power consumption of the actuator. Enlarging the opening area also gives rise to the problem of ink that fills the ink channel leaking from the nozzle when the ink jet head is subjected to even a slight vibration. Raising the discharge speed of the ink droplets requires that the volumetric change of the pressure chamber, that is, the displacement of the actuator, be increased. In order to increase the actuator displacement, a higher voltage must be impressed across the actuator, leading to an increase in power consumption of the actuator during ink discharge.

In order to increase the AL, it is conceivable to enlarge the pressure chamber. However, doing so requires an increase in the volumetric change of the pressure chamber in order to create an equivalent pressure in the chamber. This in turn requires a bigger actuator or an increase in the drive amount of the actuator. In any case, the result is an increase in the power consumption of the actuator during ink discharge. The production cost of electrical components for driving the actuators also rises accordingly. Enlarging the pressure chambers lowers the degree of integration of the ink channels. This not only increases the size of the ink jet head but also widens the nozzle spacing, posing difficulties for fine printing. From the standpoint of reducing the nozzle spacing for fine printing, it is preferable that the pressure chambers be narrow and long and extend from the manifold toward the respective nozzles. This reduces the nozzle spacing in a direction perpendicular to the direction in which the pressure chambers extend. However, the narrow and long pressure chambers reduce the efficiency of the actuators in changing the volume of the pressure chambers. Consequently, in order to attain the predetermined volumetric change, a higher voltage must be supplied to the actuators, leading to increased power consumption of the actuators during ink discharge.

Japanese Patent Application Laid-open No. 05-162311 discloses an ink jet pressure generation chamber (1) provided with an ink discharge nozzle (2). An ink supply channel (3) is tangent to the peripheral wall of the pressure generation chamber (claim 1 and FIG. 1). This publication discloses other ink jet pressure generation chambers (1), each of which is fitted with an ink discharge nozzle (2) and a deflection plate (7). Ink flows from an ink supply channel (3) into the pressure generation chamber. The deflection plate causes the ink from the supply channel to flow vortically in the pressure generation chamber (claim 2 and FIGS. 7 and 8).

SUMMARY OF THE INVENTION

The primary object of the present invention is to provide a liquid discharging apparatus that is low in power consumption and can be manufactured at low cost.

According to a first aspect of the present invention, there is provided a liquid discharging apparatus comprising: a channel unit including: a common liquid chamber; a pressure chamber having two opposite walls substantially parallel to a direction in which a pressure wave propagates in the pressure chamber; a nozzle; a separate liquid channel which is formed in the channel unit and extends from the common liquid chamber through the pressure chamber to the nozzle; an inlet port through which a liquid flows from the common liquid chamber into the pressure chamber; and an outlet port through which the liquid flows from the pressure chamber toward the nozzle;

an actuator which is fixed to the channel unit and changes a pressure of the liquid in the pressure chamber; and a barrier block which is arranged on at least one of the two opposite walls of the pressure chamber and which occupies a region crossing a straight line connecting the inlet and outlet ports.

According to a second aspect of the present invention, there is provided a liquid discharging apparatus comprising:

a channel unit including: a common liquid chamber; a pressure chamber in which a pressure wave propagates in a propagation direction and which has two opposite walls substantially parallel to the propagation direction; a nozzle; and a separate liquid channel which is formed in the channel unit and extends from the common liquid chamber through the pressure chamber to the nozzle;

an actuator which is fixed to the channel unit and changes a pressure of the liquid in the pressure chamber; and a barrier block which is arranged on at least one of the two opposite walls of the pressure chamber, wherein the barrier block makes a length of a propagation path of the pressure wave in the pressure chamber longer than a length of a propagation path of the pressure wave in the pressure chamber when the barrier block is not arranged in the pressure chamber.

It is difficult for the developed pressure wave to propagate across the barrier block, so that the pressure wave bypasses the block. This makes it possible to attain a long AL without enlarging the pressure chamber or narrowing and lengthening it. This in turn makes it possible to discharge a sufficient volume of liquid from the associated nozzle without applying a high-voltage to the actuator. As a result, it is possible to reduce the power consumption of the actuator during liquid discharge. Consequently, it is possible to reduce the cost of electrical components for driving the actuator.

In the present invention, the actuator may change a volume of the pressure chamber. The liquid discharging apparatus may further comprise a displaceable member which is displaced when the actuator is driven to change the volume of the pressure chamber. In this case, the barrier block may have a height making no contact with the displaceable member. Since no part comes in contact with the barrier block when the actuator is driven, this makes it possible to develop pressure in the entire pressure chamber.

In the present invention, the height of the barrier block may be a height which prevents the pressure wave from propagating in the region in which the barrier block is arranged. This makes it easy for the pressure wave to propagate while bypassing the barrier block. This in turn makes it possible to reliably attain a long AL.

In the present invention, the pressure chamber and the actuator may be substantially circular in planes parallel to the two opposite walls of the pressure chamber, and may be concentric with each other. This makes it possible to maximize the volumetric change of the pressure chamber when a voltage of the same amplitude is applied to the actuator.

In this case, the barrier block may extend from a side wall of the pressure chamber toward a center of the pressure chamber linearly in a plane parallel to the two opposite walls of the pressure chamber. This causes the pressure wave to propagate efficiently in an arc around the inner end of the barrier block. This in turn makes it possible to increase the AL without spoiling the ink discharge characteristic.

In the present invention, the barrier block may include a plurality of blocks arranged in a staggered manner with respect to the straight line connecting the inlet and outlet ports. The staggered barrier blocks make it possible to increase the AL efficiently.

In the present invention, the actuator may deform one of the two opposite walls of the pressure chamber to change a volume of the pressure chamber, and the barrier block may be arranged on the other of the two opposite walls. Accordingly, the wall deformation is not prevented by the barrier blocks. This makes it possible to drive the actuator efficiently.

In the present invention, the actuator may be an actuator having a thermal drive mechanism.

In the present invention, the height of the barrier block may be not less than 9/10 of a distance between the two opposite walls of the pressure chamber. This makes it easy to block the propagation of the pressure wave. The liquid discharging apparatus may be an ink jet printer.

DETAILED DESCRIPTION OF PREFERRED EMBODIMENTS

A first preferred embodiment of the present invention will be described below with reference to the drawings.

Figure 1:
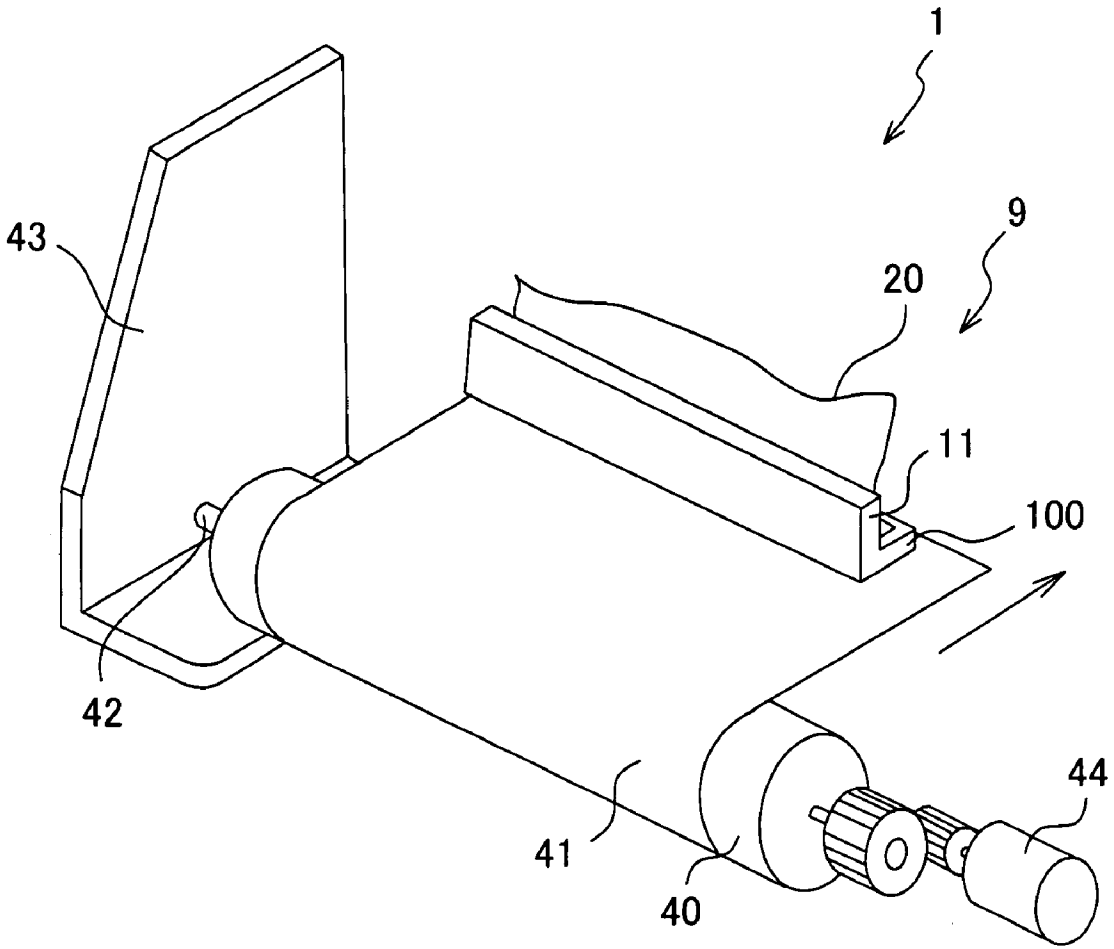
FIG. 1 is a schematic perspective view of an ink jet printer provided with an inkjet head according to a first embodiment of the present invention.

As shown in FIG. 1, an ink jet printer 1 according to this embodiment includes a platen roller 40 and an ink jet head 9. The platen roller 40 is a means for conveying paper 41 as a printing medium. The ink jet head 9 discharges ink droplets onto paper 41 set on the platen roller 40.

The platen roller 40 is fixed to a shaft 42 which is supported rotatably by a frame 43 and is rotated by a motor 44. Paper 41 is fed from a paper cassette (not shown), which is provided near the ink jet printer 1. The platen roller 40 conveys the fed paper 41 at a constant speed in the direction indicated by the straight arrow in FIG. 1. While paper 41 is conveyed, the ink jet head 9 discharges ink droplets so that a predetermined printing is performed on the paper 41. The printed paper 41 is discharged from the ink jet printer 1. FIG. 1 omits a detailed illustration of the paper feeding and discharging mechanisms. The ink jet printer 1 as shown in FIG. 1 is a monochromatic printer which includes only one ink jet head 9. For color printing, at least four ink jet heads 9 for yellow (Y), magenta (M), cyan (C) and black (K) are be positioned in parallel.

As shown in FIG. 1, the ink jet head 9 is a line head extending perpendicular to the direction in which paper 41 is conveyed. The ink jet head 9 is fixed with respect to the frame 43.

The ink jet head 9, which discharges ink droplets onto paper 41, includes a head main body 100 and a base part 11. The head main body 100 is a linearly extending rectangular parallelepiped. The bottom surface of the head main body 100 faces paper 41. The head main body 100 has a large number of nozzles 8 which will be described later on. The nozzles 8 are formed through the bottom surface of the head main body 100 (ink discharge surface) and arranged in an extending direction of the head main body 100. One end of a flexible printed circuit (FPC) 20 as a feeder circuit is connected to a surface of the head main body 100 which is opposite to the bottom surface thereof, and the other end is connected to a control unit (not shown). The base part 11 extends vertically from the top surface of the head main body 100 and supports this body so that the bottom surface of the body is positioned over and in parallel with paper 41 being conveyed by the platen roller 40.

Figure 2:
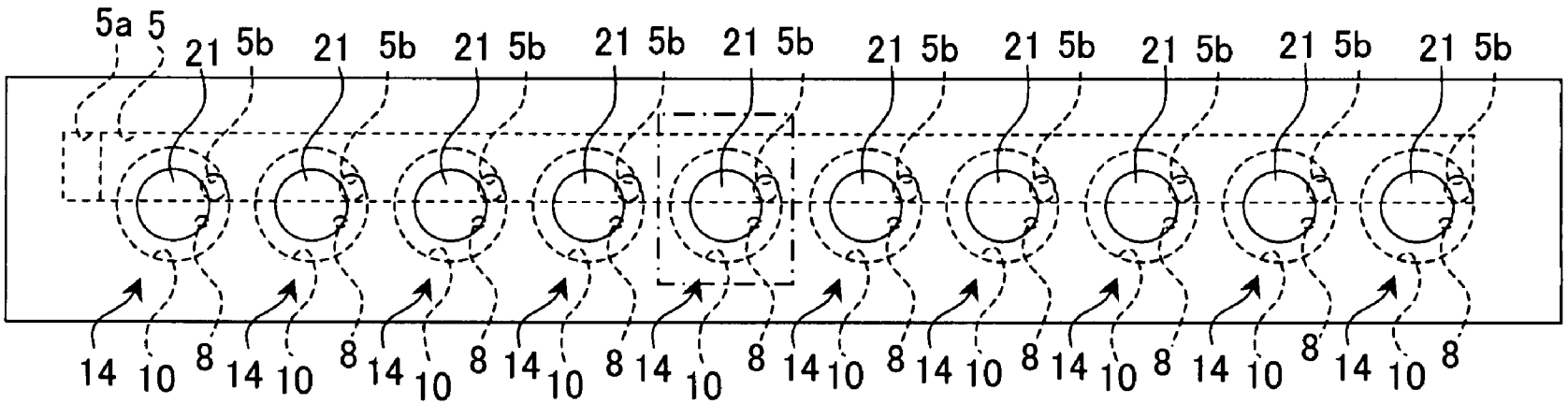
FIG. 2 is a top view of the head main body of the ink jet head shown in FIG. 1.

As shown in FIG. 2, the head main body 100 includes a channel unit 4 in the form of a linearly extending rectangular parallelepiped and actuators 21 arranged on and longitudinally of the channel unit 4. The channel unit 4 has a manifold 5 formed therein and extending in a longitudinal direction of the channel unit 4, and a large number of separate ink channels 14 (FIG. 6) formed therein and arranged in a longitudinal direction of the channel unit 4. Each of the ink channels 14 is positioned so as to correspond to one of the actuators 21.

The manifold 5 has an ink supply port 5*a* formed at one end thereof and connected to an external ink tank (not shown), from which ink flows through the supply port 5*a* into the manifold 5.

Each of the separate ink channels 14 includes one of the nozzles 8, which are formed through the bottom surface of the head main body 100, and a pressure chamber 10 circular as viewed from the top side of the head main body 100. Each pressure chamber 10 communicates with the associated nozzle 8 and has an ink inlet port 10*b*, which communicates with the manifold 5. The ink in the manifold 5 is supplied to the pressure chambers 10 through their respective inlet ports 10*b*.

The actuators 21 are circular as viewed from the top side of the head main body 100 and smaller in diameter than the pressure chambers 10. The actuators 21 are arranged on the top surface of the channel unit 4, each of which is arranged at a position corresponding to one of the pressure chambers 10. The FPC 20 (FIG. 1) is connected to the top surfaces of the actuators 21. It is possible to drive the actuators 21 by applying to the actuators 21 through the FPC 20 the drive pulse signals generated by the drive circuit of the control unit. Each of the drive pulse signals is selectively either the ground potential or the predetermined positive potential.

The head main body 100 will be described be low in detail with reference to FIGS. 3 to 7. As shown in FIGS. 4 to 7, the head main body 100 has a laminated structure formed by laminating the actuators 21 and channel unit 4. The actuators 21 are bonded to the channel unit 4 with a heat-curable epoxy adhesive.

The channel unit 4 is formed by laminating an actuator plate 22, a cavity plate 23, a supply plate 24, a manifold plate 25 and a nozzle plate 26. The nozzle plate 26 is formed of polyimide or other synthetic resin and has nozzles 8 formed therethrough, from which ink is discharged. The other four plates 22 to 25 are formed of stainless steel or other metallic material. The plates 22 to 25 are substantially rectangular and thin, each having a thickness between 50 and 150 micrometers. The plates 22 to 25 are laminated and bonded together with an adhesive applied to their adjacent surfaces. The top surface of the actuator plate 22 at the top of the channel unit 4 is in contact with the actuators 21. The lower surface of the actuator plate 22 is the top wall surface of the pressure chambers 10 arranged thereunder.

Figure 3:
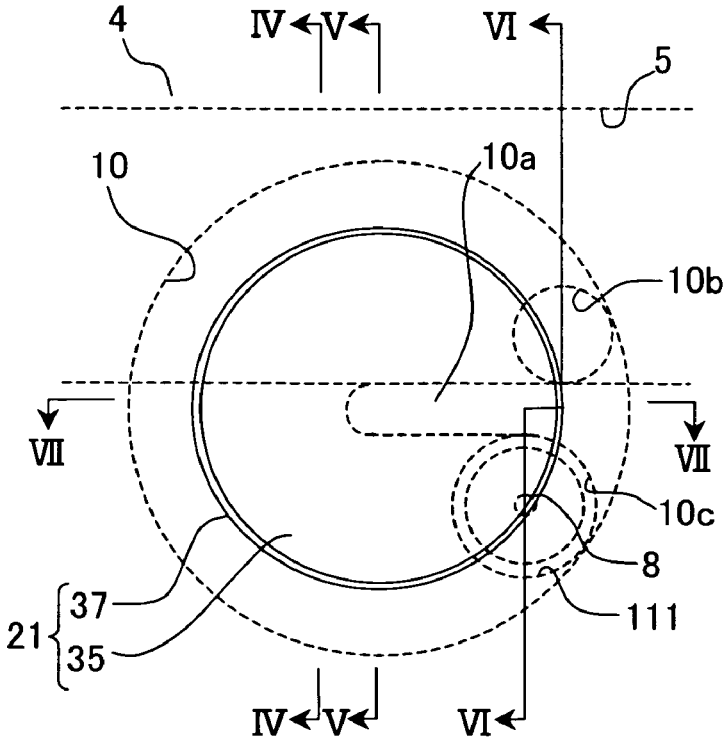
FIG. 3 is an enlarged view of the region surrounded by the chain lines in FIG. 2.
Figure 4:
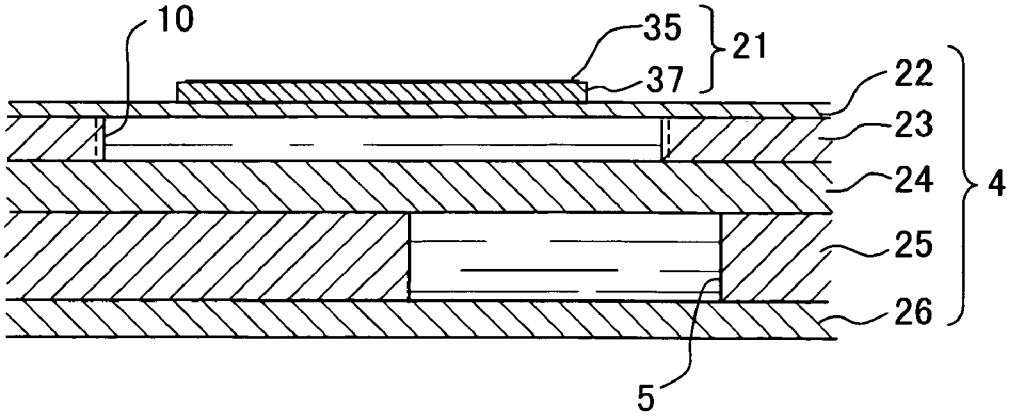
FIG. 4 is a cross section taken along line IV-IV in FIG. 3.
Figure 7:
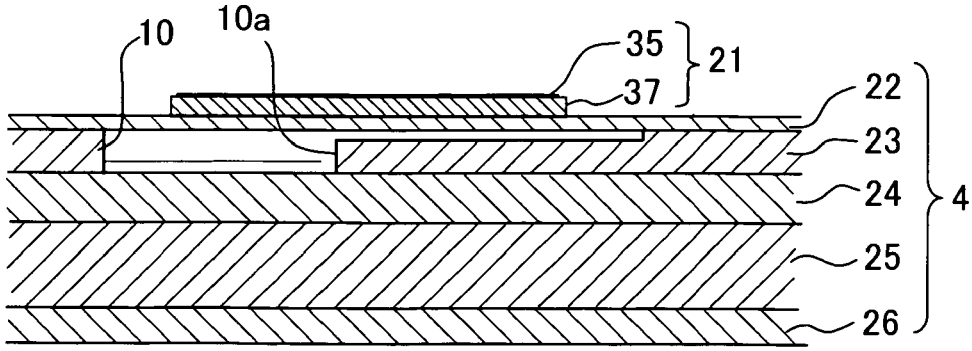
FIG. 7 is a cross section taken along line VII-VII in FIG. 3.

A plurality of pressure chambers 10 are formed through the cavity plate 23 and arranged in a line along the extending direction of the head main body 100. As shown in FIG. 3, the pressure chambers 10 are circular as viewed from the top side of the head main body 100. Each pressure chamber 10 is fitted with a barrier block 10*a*, which is linear in plan view and extends from its peripheral wall to a point near its center. As shown in FIG. 7, the height of the barrier block 10*a* is not less than 9/10 of the depth of the pressure chamber 10 (thickness of the cavity plate 23). The height of the barrier block 10*a* is low enough to be kept out of contact with the actuator plate 22 even when the actuator plate 22 deforms to project toward the pressure chamber 10. The actuator plate 22 will be described later on in detail. The barrier block 10*a* is formed by half etching of the cavity plate 23 at a depth of not more than 1/10.

Figure 6:
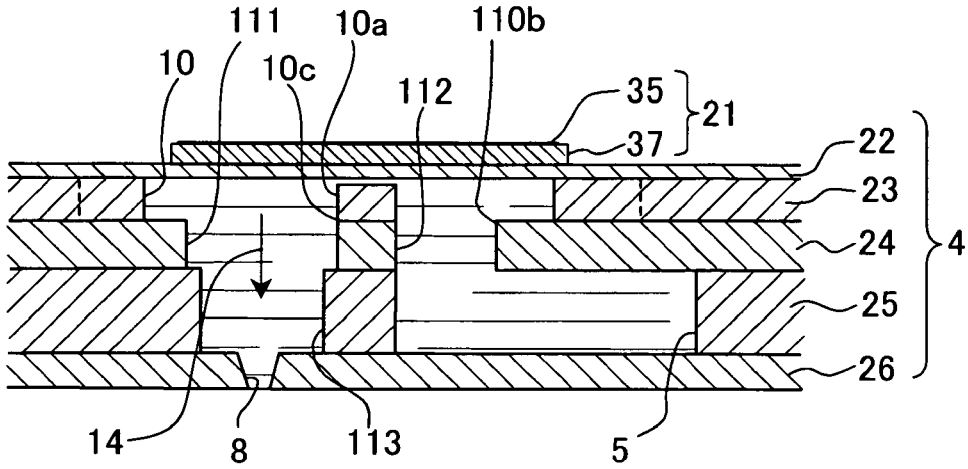
FIG. 6 is a cross section taken along line VI-VI in FIG. 3.

As shown in FIGS. 3 and 6, the supply plate 24 has communication holes 111 and 112 formed therethrough and arranged in line under and along the line of pressure chambers 10. Each communication hole 111 communicates with one of the pressure chambers 10. Each communication hole 112 connects one of the pressure chambers 10 to the manifold 5. Each communication hole 111 and each communication hole 112 are an ink outlet port 10*c* and an ink inlet port 10*b*, respectively, which communicate with the associated pressure chamber 10. As viewed from the top side of the head main body 100, each barrier block 10*a* is positioned between the associated ports 10*b* and 10*c* near the peripheral wall of the associated pressure chamber 10. In other words, each barrier block 10*a* crosses the line segment connecting the associated ports 10*b* and 10*c*. Portions of the supply plate 24 are the bottom walls of the pressure chambers 10. The supply plate 24 lies under and in parallel with the actuator plate 22, portions of which are the top walls of the pressure chambers 10. The barrier blocks 10*a* in the respective pressure chambers 10 are arranged on the supply plate 24.

As shown in FIGS. 3 to 6, the manifold plate 25 has communication holes 113 formed therethrough, which are arranged in a line under and along the line of communication holes 111. Each communication hole 113 connects one of the communication holes 111 to the associated nozzle 8. The manifold 5, which supplies the pressure chambers 10 with ink, is formed through the manifold plate 25 below the pressure chambers 10. The manifold 5 extends along the line of communication holes 112 and communicates with them.

As shown in FIGS. 3 and 6, the nozzles 8 are formed through the nozzle plate 26 and arranged in a line under and along the line of communication holes 113. Thus, the separate ink channels 14 are arranged longitudinally of the channel unit 4, and each of the separate channels 14 extends from the associated pressure chamber 10 through the associated communication holes 111 and 113 to the associated nozzle 8.

Each actuator 21 changes the volume of the associated pressure chamber 10 to develop pressure in the pressure chamber 10. The actuators 21 are circular in plan view, each of which is concentric with the associated pressure chamber 10 as viewed from the top side of the head main body 100. Each actuator 21 has a laminated structure formed by laminating a separate electrode 35 and a piezoelectric sheet 37. The piezoelectric sheet 37 is circular and formed of lead zirconate titanate (PZT) or other ferroelectric ceramic material. The bottom surface of the piezoelectric sheet 37 is adjacent to the actuator plate 22 which serves as the top wall of the pressure chambers 10. The potential of the actuator plate 22 is maintained at the ground potential, and this plate functions as an electrode common to the actuators 21. The separate electrode 35 is made of Ag—Pd or other metallic material and connected to the FPC 20. The separate electrode 35 is circular and concentric with the associated piezoelectric sheet 37. The separate electrode 35 is slightly smaller in diameter than the piezoelectric sheet 37 so as to be kept out of contact with the actuator plate 22.

The piezoelectric sheet 37 is polarized across its thickness. Application of potential higher than the ground potential to the separate electrode 35 results in an electric field being applied to a portion of the piezoelectric sheet 37 in the direction of polarization. The field application causes this sheet portion to act as an active layer, which tends to expand up and down and contract transversely due to a piezoelectric transverse effect. This causes the piezoelectric sheet 37 and actuator plate 22 deform to project toward the pressure chamber 10 (unimorph deformation). In other words, unimorph drive mechanisms are realized in the actuators 21.

Figure 5:
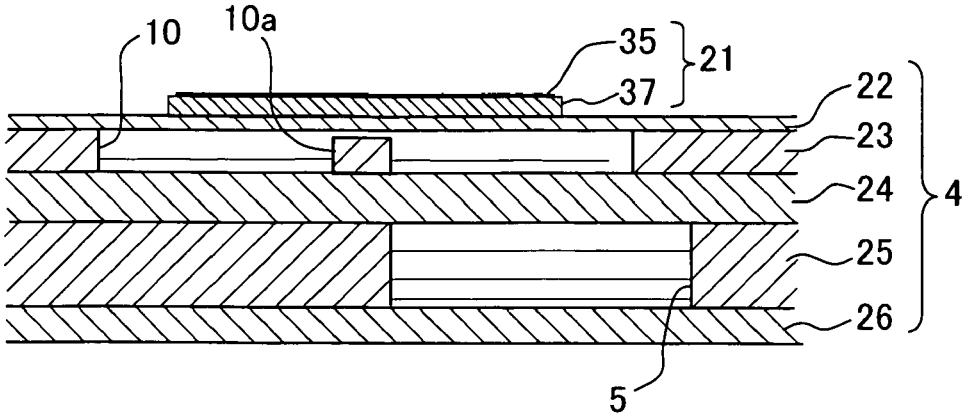
FIG. 5 is a cross section taken along line V-V in FIG. 3.
Figure 8:
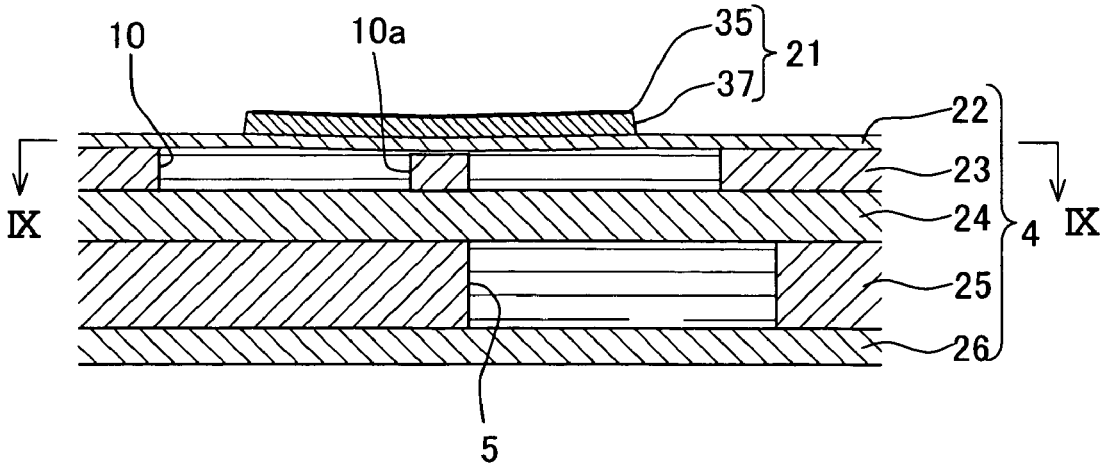
FIG. 8 is a cross section taken along line V-V in FIG. 3 when an actuator of the ink jet head is driven.
Figure 9:
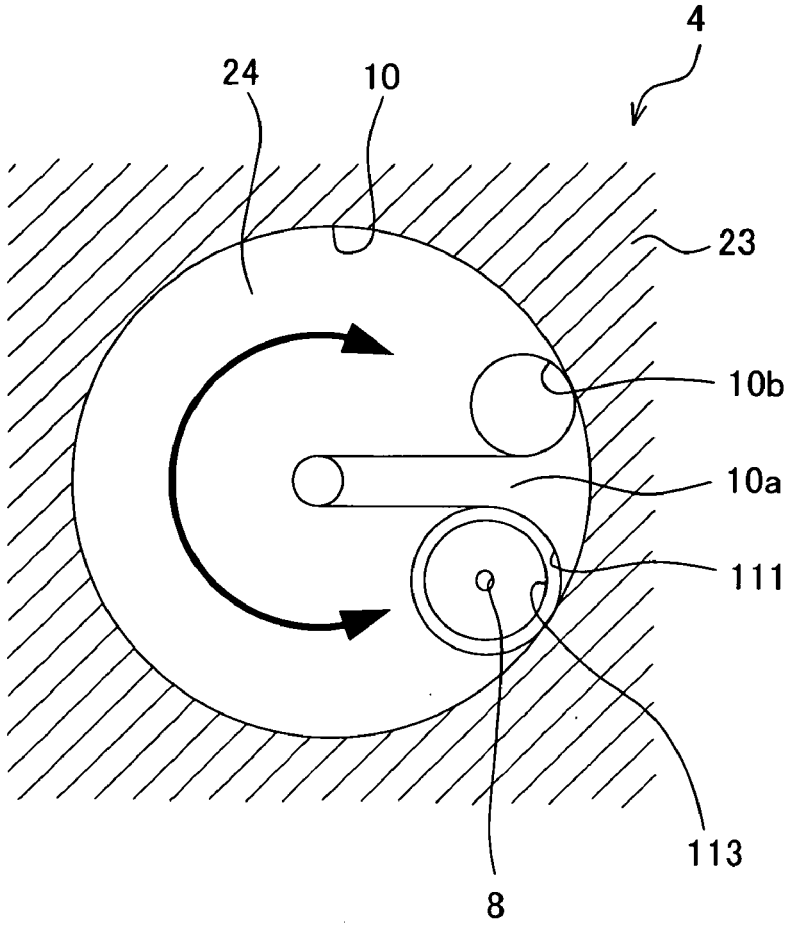
FIG. 9 is a cross section taken along line IX-IX in FIG. 8.

With reference to FIGS. 8 and 9, a description will be provided of how the head main body 100 discharges ink. In FIG. 9, the thick arrows indicate pressure wave propagation paths. The control unit applies the predetermined potential to the separate electrodes 35 in advance so that, as shown in FIG. 8, the actuators 21 and the portions of the actuator plate 22 that are adjacent to the actuators 21 deform downwardly, namely deform to project toward the associated pressure chambers 10. The downward deformation of the portions of the actuator plate 22 is such that they are still out of contact with the barrier blocks 10*a*. In accordance with a discharge request, the control unit decreases the potential applied to the appropriate separate electrodes 35 to the ground potential so that the associated actuators 21 and the portions of the actuator plate 22 that are adjacent to these actuators are flat once (FIG. 5). At the predetermined timing thereafter, the predetermined potential is applied to the separate electrodes 35 so that the actuators 21 and the adjacent plate portions deform downward again. During this process, the volume of the associated pressure chambers 10 increases once and returns subsequently to the reduced volume.

When the volume of a pressure chamber 10 is increased once, a negative pressure is generated in this chamber, so that the chamber 10 sucks ink from the manifold 5 through the associated inlet port 10*b*. When the volume of the pressure chamber 10 is returned to the reduced volume, a positive pressure is generated in this chamber, so that a pressure wave is generated. The volume of the pressure chamber 10 is decreased when the negative pressure in the chamber 10 reverses to a positive pressure. This combines two positive pressures, creating a high positive pressure, which acts on the associated nozzle 8 to start discharging an ink droplet from this nozzle.

In order to discharge an ink droplet from the nozzle 8, a rectangular drive pulse signal is applied to the associated separate electrode 35. In order to maximize the volume of the ink droplet and the speed at which the ink droplet is discharged, the pulse width of the drive pulse signal is set at the AL for a pressure wave generated in the pressure chamber 10 to propagate from the associated inlet port 10*b* to the nozzle 8. After the ink droplet starts to be discharged, as shown in FIG. 9, a negative pressure wave propagates from the manifold 5 through the inlet port 10*b* to the pressure chamber 10. This pressure wave propagates from the inlet port 10*b* to the associated communication hole 111, bypassing the associated barrier block 10*a*. As a result, the AL is long in comparison with a case where there is no barrier block 10*a*. This makes it possible to delay the timing when the pressure near the nozzle 8 lowers, that is, when the ink discharge ends.

The pressure wave generated in the pressure chamber 10 does not propagate across the barrier block 10*a*, but bypasses the barrier block 10*a*. This makes it possible to increase the AL in comparison with a case where there is no barrier block 10*a*. This also makes it possible to attain a long AL without enlarging the pressure chamber 10 or narrowing and lengthening the pressure chamber 10. This in turn makes it possible to discharge a sufficient volume of ink without applying a high voltage to the associated actuator 21. As a result, it is possible to reduce the power consumption of the actuator 21 during ink discharge. Consequently, it is possible to reduce the cost of electrical components for driving the actuators 21.

The pressure chambers 10 and actuators 21 are circular in plan view. Each pressure chamber 10 is concentric with the associated actuator 21. This improves the deformation efficiency of the actuator 21, which is the ratio of the amount of deformation of the actuator to the area of the actuator. This in turn makes it possible to change the volume of the pressure chamber 10 sufficiently by applying the minimum voltage. As a result, the power consumption of the actuator 21 can be lower.

In plan view, each barrier block 10*a* extends linearly from the center of the associated pressure chamber 10 to the peripheral wall of the chamber. The pressure wave generated in the pressure chamber 10 propagates smoothly in an arc along the peripheral wall of the pressure chamber around the inner end of the barrier block 10*a*. This makes it possible to increase the AL without spoiling the ink discharge characteristic.

The barrier blocks 10*a* is arranged on the supply plate 24, which faces the actuator plate 22. This makes it possible to drive the actuators 21 efficiently without the barrier blocks 10*a* preventing the deformation of the actuator plate 22.

A second embodiment of the present invention will be described below with reference to FIG. 10 which is a cross section of the head main body of this embodiment, and corresponds to the cross section along line IX-IX in FIG. 8. The parts or members in FIG. 10 that are substantially identical with the counterparts in the first embodiment will not be described, but will be assigned the same reference numerals as the counterparts are assigned.

The channel unit 4A of this head main body is formed by laminating an actuator plate 22, a cavity plate 23A, a supply plate 24A, a manifold plate 25 and a nozzle plate 26. The nozzle plate 26 is formed of polyimide or other synthetic resin and has nozzles 8 formed therethrough, from which ink is discharged. The other four plates 22, 23A, 24A and 25 are thin and formed of metallic material.

The cavity plate 23A has a plurality of pressure chambers 10A formed therethrough which are arranged in a line along an extending direction of the head main body 10A. As shown in FIG. 10, the pressure chambers 10A are circular as viewed from the top side of the head main body 10A. Each pressure chamber 10A is fitted with a barrier block 10*a*A in the form of a vortex in plan view, which extends from its peripheral wall toward its center counterclockwise in FIG. 10. The height of the barrier block 10*a*A is not less than 9/10 of the depth of the pressure chamber 10A (the thickness of the cavity plate 23A). The height of the barrier block 10*a*A is low enough to be kept out of contact with the actuator plate 22 even when this plate deforms to project toward the pressure chamber 10. The barrier block 10*a*A is formed by half etching of the cavity plate 23A at a depth of not more than 1/10.

Figure 10:
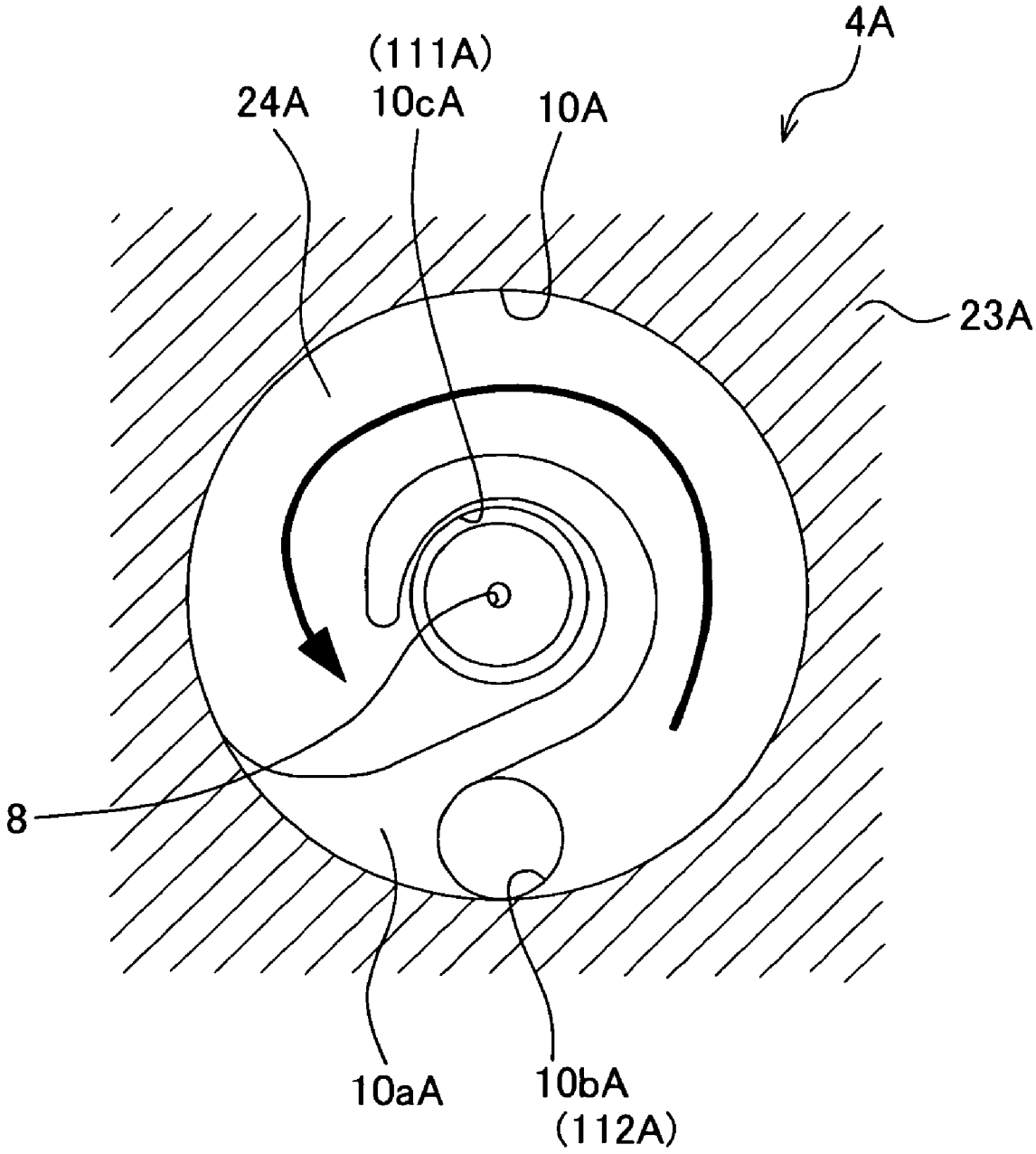
FIG. 10 is a sectional top view of a pressure chamber of an ink jet head according to a second embodiment of the present invention.

As shown in FIG. 10, the supply plate 24A has communication holes 111A and 112A formed therethrough, which are arranged in line under and along the line of pressure chambers 10A. Each communication hole 111A connects one of the pressure chambers 10A to a communication hole (not shown) of the manifold plate 25, which communicates with one of the nozzles 8. Each communication hole 112A connects one of the pressure chambers 10A to the manifold 5. Each communication hole 111A and each communication hole 112A are an ink outlet port 10*c*A and an ink inlet port 10*b*A, respectively, which communicate with the associated pressure chamber 10A. As viewed from the top side of the head main body 10A, the inlet port 10*b*A adjoins the peripheral wall of the pressure chamber 10A and the outer vortical surface of the associated barrier block 10*a*A. As viewed from the same side, the outlet port 10$c$A is positioned at the center of the pressure chamber 10A and adjoins an inner end portion of the inner vortical surface of the barrier block 10$a$A. The barrier block 10$a$A crosses the line segment connecting the centers of ink inlet port 10$b$A and ink outlet port 10$c$A.

As indicated by the thick arrow in FIG. 10, the barrier block 10$a$A causes a pressure wave to propagate vertically in an arc from the peripheral wall of the pressure chamber 10A along this block toward the center of this chamber. This makes it possible to attain a long AL without disturbing the pressure wave. The AL is longer than that in a case where there is no barrier block 10$a$A. The long AL makes it possible to discharge a sufficient volume of ink without applying a high voltage to the associated actuator 21. As a result, electric power can be saved. It is also possible to reduce the cost of electrical components for driving the actuators 21.

A third embodiment of the present invention will be described below with reference to FIG. 11 which is a cross section of the head main body of this embodiment, and corresponds to the cross section along line IX-IX in FIG. 8. The parts or members in FIG. 11 that are substantially identical with the counterparts in the first embodiment will not be described, but will be assigned the same reference numerals as the counterparts are assigned.

The channel unit 4B of this head main body is formed by laminating an actuator plate 22, a cavity plate 23B, a supply plate 24B, a manifold plate 25 and a nozzle plate 26. The nozzle plate 26 is formed of polyimide or other synthetic resin and has nozzles 8 formed therethrough from which ink is discharged. The other four plates 22, 23B, 24B and 25 are thin and formed of metallic material.

The cavity plate 23B has a plurality of pressure chambers 10B formed therethrough and arranged in a line along the extending direction of the head main body 100B. As shown in FIG. 11, the pressure chambers 10B are circular as viewed from the top side of the head main body 100B. Each pressure chamber 10B is fitted with two barrier blocks 10$a$B, which are symmetrical around the center of the pressure chamber 10B and extend from the peripheral wall toward the center of the pressure chamber 10B. The height of the barrier blocks 10$a$B is not less than 9/10 of the depth of the pressure chamber 10B (the thickness of the cavity plate 23B). The height of the barrier blocks 10$a$B is low enough to be kept out of contact with the actuator plate 22 even when this plate deforms downwardly, namely deforms to project toward the pressure chamber 10B. The barrier blocks 10$a$B are formed by half etching of the cavity plate 23B at a depth of not more than 1/10.

Figure 11:
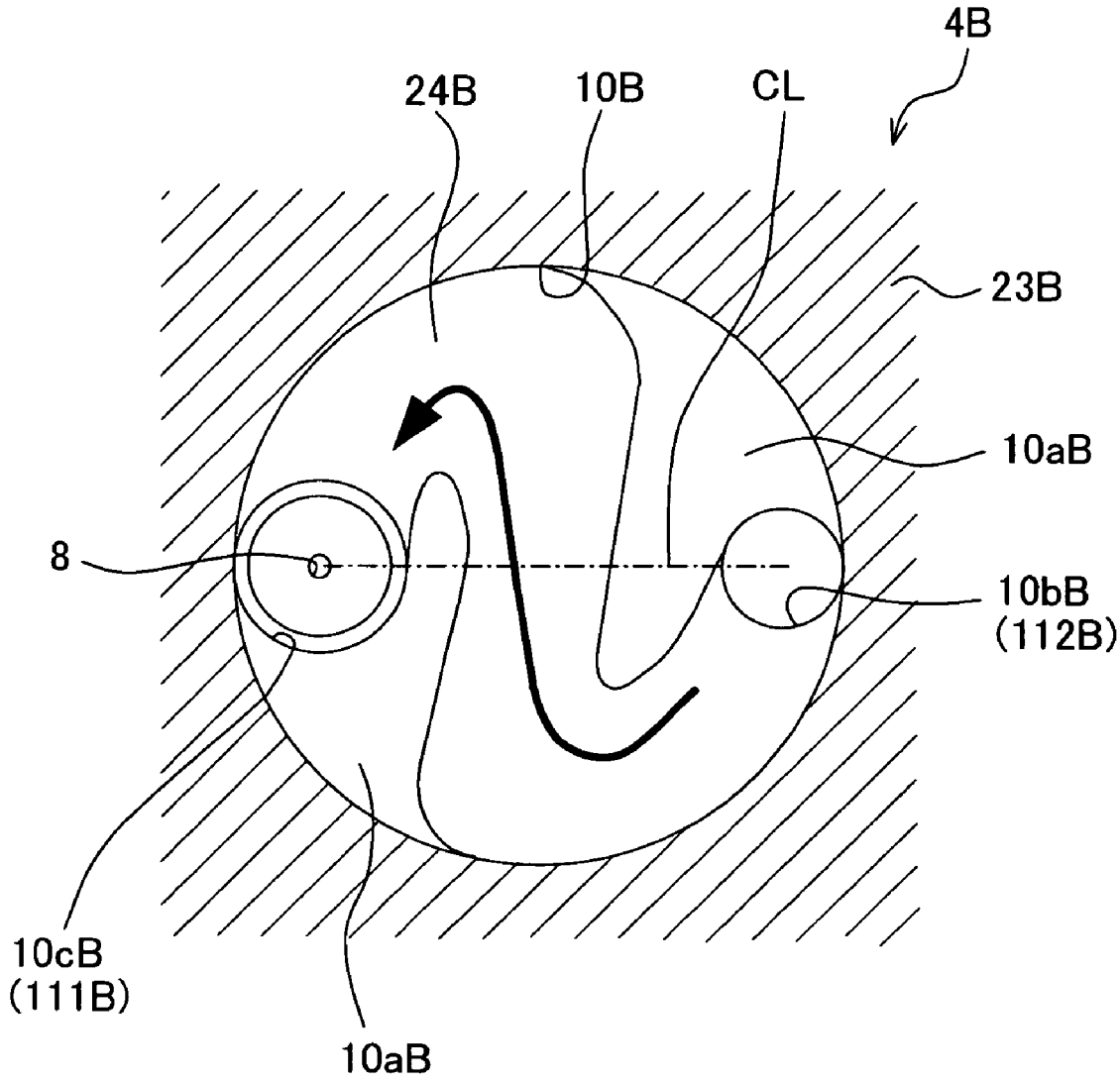
FIG. 11 is a sectional top view of a pressure chamber of an ink jet head according to a third embodiment of the present invention.

As shown in FIG. 11, the supply plate 24B has communication holes 111B and 112B formed therethrough, which are arranged in line under and along the line of pressure chambers 10B. Each communication hole 111B connects one of the pressure chambers 10B to a communication hole (not shown) of the manifold plate 25, which communicates with one of the nozzles 8. Each communication hole 112B connects one of the pressure chambers 10B to the manifold 5. Each communication hole 111B and each communication hole 112B are an ink outlet port 10$c$B and an ink inlet port 10$b$B, respectively, which communicate with the associated pressure chamber 10B. The barrier blocks 10$a$B in each pressure chamber 10B incline in one direction around its center. Each barrier block 10$a$B has a first side adjacent to the peripheral wall of the associated pressure chamber 10B and a second side adjacent to the center of the chamber. As viewed from the top side of the head main body 100B, each of the ports 10$b$B and 10$c$B for each pressure chamber 10B is positioned between the peripheral wall of the chamber and the first side of one of the associated barrier blocks 10$a$B. The two barrier blocks 10$a$B are staggered with respect to the straight line CL connecting the centers of the ports 10$b$B and 10$c$B, and cross the straight line CL.

As indicated by the thick arrow in FIG. 11, the barrier blocks 10$a$B cause a pressure wave to propagate trailing a S-shaped trajectory or a sine curve from a point adjacent to the peripheral wall of the pressure chamber 10B toward the opposite point adjacent to this wall, passing through the space between inner end portions of the two blocks 10$a$B. This makes it possible to increase the AL in comparison with a case where there is no barrier block 10$a$B. This in turn makes it possible to attain a longer AL without disturbing the pressure wave. It is consequently possible to discharge a sufficient volume of ink without applying a high voltage to the associated actuator 21. As a result, electric power can be saved. It is also possible to reduce the cost of electrical components for driving the actuators 21.

In the three embodiments, the pressure chambers are circular in cross section. The inlet and outlet ports of each of the pressure chambers are connected together by the associated ink channel. The presence of the barrier block or blocks in the pressure chamber makes the ink channel longer than the radius (or the diameter) of the chamber. It is noteworthy that the ink channel can be lengthened suitably by varying the shape of the barrier block or blocks.

A fourth embodiment of the present invention will be described below with reference to FIG. 12 which is a cross section of the head main body of this embodiment, and corresponds to the cross section along line IX-IX in FIG. 8. The parts or members in FIG. 12 that are substantially identical with the counterparts in the first embodiment will not be described, but will be assigned the same reference numerals as the counterparts are assigned.

The channel unit 4C of this head main body is formed by laminating an actuator plate 22, a cavity plate 23C, a supply plate 24C, a manifold plate 25 and a nozzle plate 26. The nozzle plate 26 is formed of polyimide or other synthetic resin and has nozzles 8 formed therethrough from which ink is discharged. The other four plates 22, 23C, 24C and 25 are thin and formed of metallic material.

The cavity plate 23C has a plurality of pressure chambers 10C formed therethrough which are arranged in a line along the extending direction of the head main body 100C. As shown in FIG. 12, the pressure chambers 10C are substantially elliptic as viewed from the top side of the head main body 100C. Each pressure chamber 10C has a pair of parallel side walls 10$d$C extending along the extending direction of the pressure chamber 10C. Each pressure chamber 10C is fitted with two barrier blocks 10$a$C, which are symmetrical around its center. Each barrier block 10$a$C extends from one of the side walls 10$d$C toward the center of the pressure chamber 10C. The height of the barrier blocks 10$a$C is not less than 9/10 of the depth of the pressure chamber 10C (the thickness of the cavity plate 23C). The height of the barrier blocks 10$a$C are low enough to be kept out of contact with the actuator plate 22 even when this plate deforms to project toward the pressure chamber 10C. The barrier blocks 10$a$C are formed by half etching of the cavity plate 23C at a depth of not more than of 1/10.

Figure 12:
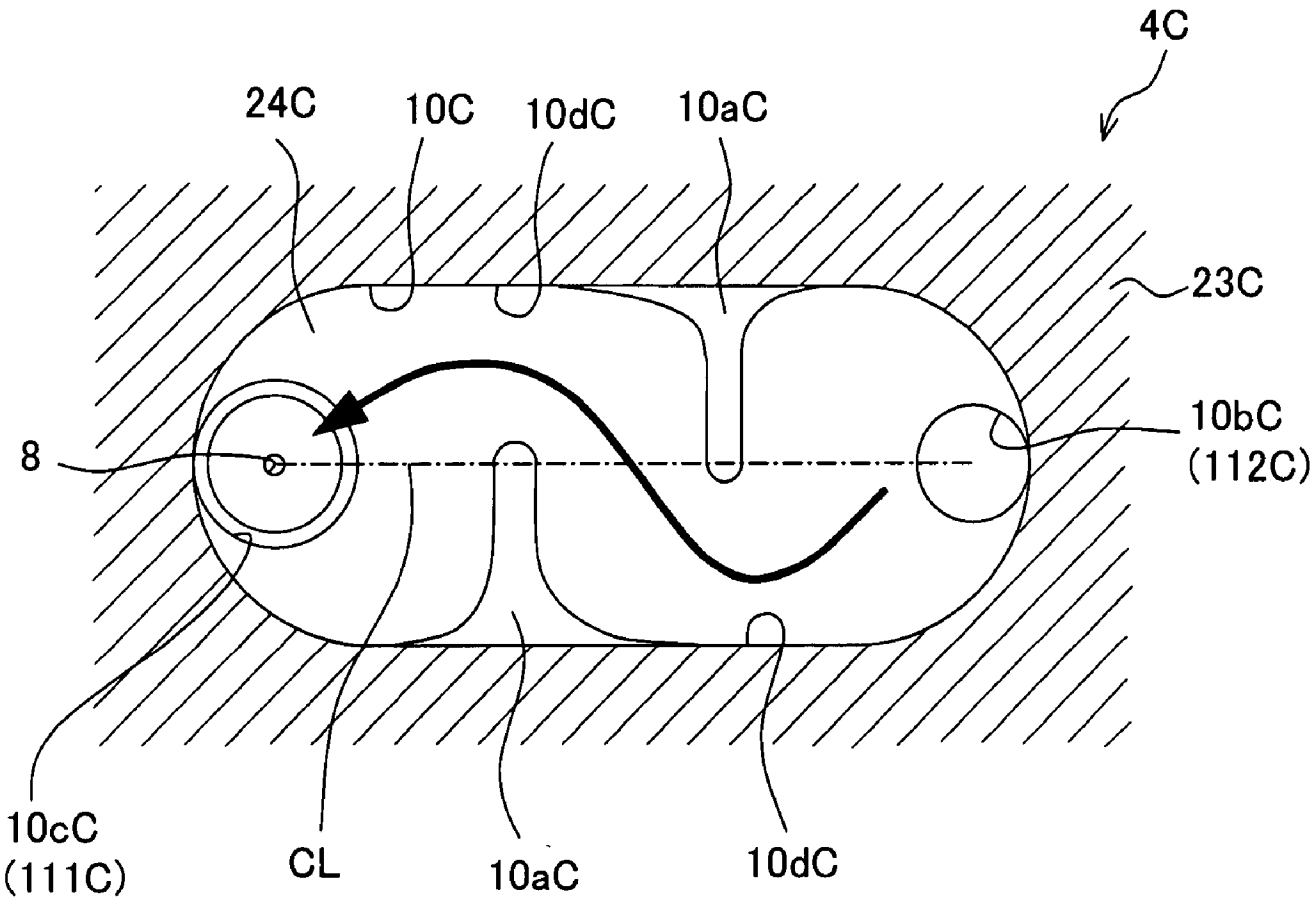
FIG. 12 is a sectional top view of a pressure chamber of an ink jet head according to a fourth embodiment of the present invention.

As shown in FIG. 12, the supply plate 24C has communication holes 111C and 112C formed therethrough and are arranged in line under and along the line of pressure chambers 10C. Each communication hole 111C connects one of the pressure chambers 10C to a communicating hole (not shown) of the manifold plate 25, which communicates with one of the nozzles 8. Each communication hole 112C connects one of the pressure chambers 10C to the manifold 5. Each communication hole 111C and each communication hole 112C are an ink outlet port 10*c*C and an ink inlet port 10*b*C, respectively, which communicate with the associated pressure chamber 10C. As viewed from the top side of the head main body 100C, each of the ports 10*b*C and 10*c*C for each pressure chamber 10C is adjacent to one of the end walls in the extending direction of the pressure chamber 10C. The barrier blocks 10*a*C in each pressure chamber 10C extend in a direction orthogonal to the straight line CL connecting the centers of the associated ports 10*b*C and 10*c*C (in a direction orthogonal to the extending direction of the pressure chamber 10C). The barrier blocks 10*a*C are staggered with respect to the straight line CL and cross the straight line CL.

As indicated by the thick arrow in FIG. 12, the barrier blocks 10*a*C cause a pressure wave to propagate trailing an S-shaped trajectory or a sine curve from one of the end walls of the pressure chamber 10C toward the other of the end walls, passing through the space between inner end portions of the blocks 10*a*C. This makes it possible to increase the AL in comparison with a case where there is no barrier block 10*a*C. This in turn makes it possible to attain a longer AL without disturbing the pressure wave. It is consequently possible to discharge a sufficient volume of ink without applying a high voltage to the associated actuator 21. As a result, electric power can be saved. It is also possible to reduce the cost of electrical components such as FPC 20 for driving the actuators 21.

Figure 13:
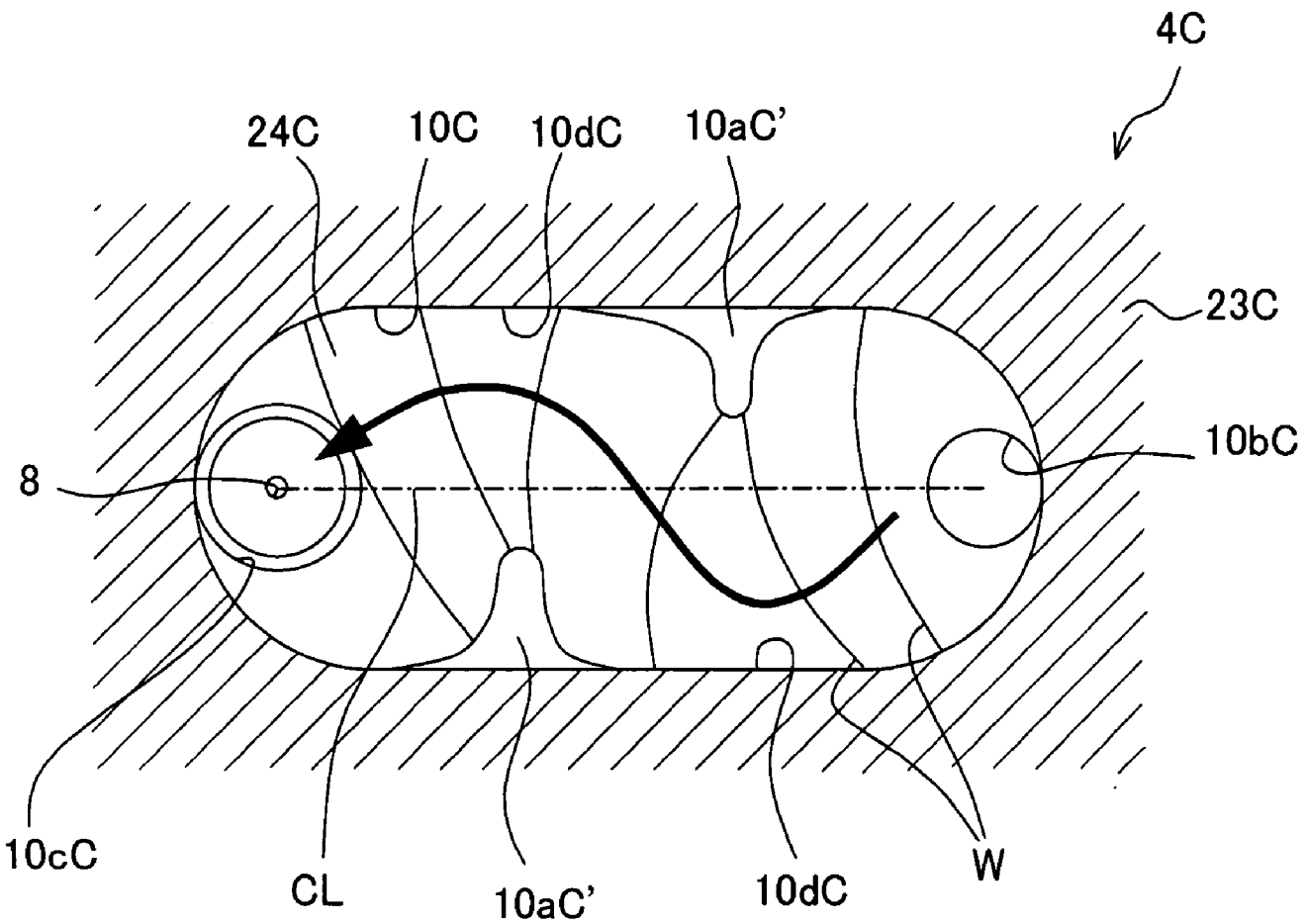
FIG. 13 is a sectional top view of a modification to the pressure chamber shown in FIG. 12.

Although the barrier blocks 10*a*C cross the straight line CL, the barrier blocks 10*a*C may have another structure that enables a pressure wave to propagate on a detour. For example, as shown in FIG. 13, each pressure chamber 10C may be provided with two barrier blocks 10*a*C'. The length of the barrier blocks 10*a*C' is not less than a half of the distance between one of the side walls 10*d*C of the pressure chamber 10C and the straight line CL, but the blocks 10*a*C' do not cross the line CL. As indicated by wavy lines W in FIG. 13, the pressure wave extends laterally of the pressure chamber 10C, with the wave ends interfering with the barrier blocks 10AC' in order. Accordingly, as indicated by the thick arrow in FIG. 13, the pressure wave propagates trailing an S-shaped trajectory or a sine curve.

Figure 14:
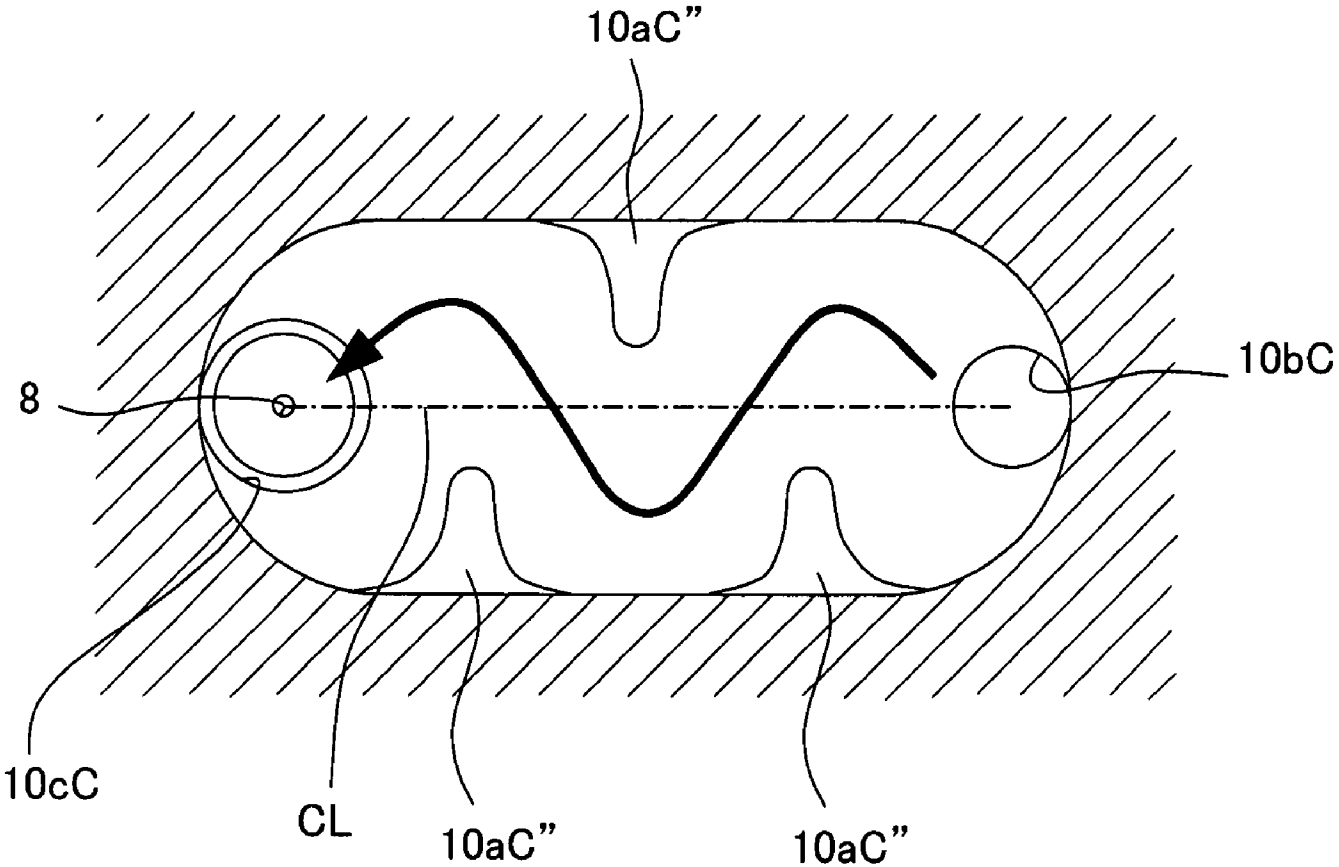
FIG. 14 is a sectional top view of a modification to the pressure chamber shown in FIG. 13. Three barrier blocks are formed in the pressure chamber shown in FIG. 14.

In the pressure chamber shown in each of FIGS. 12 and 13, the barrier blocks cause the ink channel connecting the inlet and outlet ports to meander along the straight line between the ports. The amplitude and period of the meandering can be varied arbitrarily by adjusting the lengths of the barrier blocks and the spacing between the blocks. As shown in FIG. 14, three barrier blocks 10*a*C" may be formed in each of the pressure chambers. Four or more barrier block may be formed in each of the pressure chambers to shorten the period of the meandering of the ink channel.

The present invention is not limited to the preferred embodiments described hereinbefore, but various modifications may be made within the scope of the appended claims. For example, in the first embodiment, the pressure chambers 10 and actuators 21 are circular in plan view. Each pressure chamber 10 is concentric with the associated actuator 21. However, the pressure chambers 10 and actuators 21 may not be circular in plan view and may have different shapes. Particularly in the first embodiment, the actuators 21 is disposed for each of the pressure chambers 10. Alternatively, an actuator unit may be used which includes a piezoelectric sheet which extend over all of the pressure chambers 10 and separate electrodes each of which is disposed at a position corresponding to one of the pressure chambers 10 so that the piezoelectric sheet can be driven independently for the chambers 10.

In the first embodiment, the actuator plate 22 is provided between the actuator 21 and the pressure chamber 10. However, the actuator plate 22 may be omitted. In this case, the size and/or construction of the actuator 21 may be changed so that the actuator 21 directly covers the pressure chamber 10.

In the first embodiment, the barrier blocks 10*a* is arranged on the supply plate 24, but the barrier blocks 10*a* may be arranged on a position other than on the supply plate 24. For example, the barrier blocks 10*a* may be disposed on the actuator plate 22. Alternatively, each barrier block 10*a* may be divided into an upper block and a lower block, which may be disposed on the actuator plate 22 and supply plate 24, respectively.

In the first embodiment, the height of the barrier blocks 1*a* is not less than 9/10 of the depth of the pressure chambers 10. However, as far as the barrier blocks 10*a* prevent a pressure wave from passing across them, the height may be less than 9/10 of the chamber depth.

In the first embodiment, each of the actuators 21 is provided with a unimorph drive mechanism, but may be provided, for example, with a bimorph drive mechanism, a thermal drive mechanism in which an actuator is provided in the inside of the pressure chamber and the parts or members constructing the head are not deformed when the actuator is driven, or another drive mechanism, or might be driven electrostatically or magnetically.

In the four embodiments, the inlet and outlet ports are formed in the pressure chambers. Alternatively, at least one of the inlet and outlet ports of each of the pressure chambers may be formed outside the pressure chamber and communicate therewith via ink channel piping or the like.

What is claimed is:

1. A liquid discharging apparatus comprising:

a channel unit including a common liquid chamber; a pressure chamber having two opposite walls substantially parallel to a direction in which a pressure wave propagates in the pressure chamber; a nozzle; a separate liquid channel which is formed in the channel unit and extends from the common liquid chamber through the pressure chamber to the nozzle; an inlet port through which a liquid flows from the common liquid chamber into the pressure chamber; and an outlet port through which the liquid flows from the pressure chamber toward the nozzle;

an actuator which is fixed to the channel unit and changes a pressure of the liquid in the pressure chamber; and a barrier block which is arranged on at least one of the two opposite walls of the pressure chamber and which occupies a region crossing a straight line connecting the inlet and outlet ports.

2. The liquid discharging apparatus according to claim 1, wherein the actuator changes a volume of the pressure chamber.

3. The liquid discharging apparatus according to claim 2, further comprising a displaceable member which is displaced when the actuator is driven to change the volume of the pressure chamber.

4. The liquid discharging apparatus according to claim 3, wherein the barrier block has a height making no contact with the displaceable member.

5. The liquid discharging apparatus according to claim 4, wherein the height of the barrier block is a height which prevents the pressure wave from propagating in the region in which the barrier block is arranged.

6. The liquid discharging apparatus according to claim 4, wherein the height of the barrier block is not less than 9/10 of a distance between the two opposite walls of the pressure chamber.

7. The liquid discharging apparatus according to claim 1, wherein the pressure chamber and the actuator are substantially circular in planes parallel to the two opposite walls of the pressure chamber, and are concentric with each other.

8. The liquid discharging apparatus according to claim 7, wherein the barrier block extends from a sidewall of the pressure chamber toward a center of the pressure chamber linearly in a plane parallel to the two opposite walls of the pressure chamber.

9. The liquid discharging apparatus according to claim 1, wherein the barrier block includes a plurality of blocks arranged in a staggered manner with respect to the straight line connecting the inlet and outlet ports.

10. The liquid discharging apparatus according to claim 1, wherein the actuator deforms one of the two opposite walls of the pressure chamber to change a volume of the pressure chamber, and wherein the barrier block is arranged on the other of the two opposite walls.

11. The liquid discharging apparatus according to claim 1, wherein the barrier block creates an annular or meandering channel in the pressure chamber.

12. The liquid discharging apparatus according to claim 1, wherein the actuator is an actuator having a thermal drive mechanism.

13. The liquid discharging apparatus according to claim 1, which is an ink jet printer.

14. A liquid discharging apparatus comprising:

a channel unit including a common liquid chamber; a pressure chamber in which a pressure wave propagates in a propagation direction and which has two opposite walls substantially parallel to the propagation direction; a nozzle; and a separate liquid channel which is formed in the channel unit and extends from the common liquid chamber through the pressure chamber to the nozzle;

an actuator which is fixed to the channel unit and changes a pressure of the liquid in the pressure chamber; and a barrier block which is arranged on at least one of the two opposite walls of the pressure chamber, wherein the barrier block makes a length of a propagation path of the pressure wave in the pressure chamber longer than a length of a propagation path of the pressure wave in the pressure chamber when the barrier block is not arranged in the pressure chamber.

15. The liquid discharging apparatus according to claim 14, wherein the actuator changes a volume of the pressure chamber.

16. The liquid discharging apparatus according to claim 15, further comprising a displaceable member which is displaced when the actuator is driven to change the volume of the pressure chamber.

17. The liquid discharging apparatus according to claim 16, wherein the barrier block has a height making no contact with the displaceable member.

18. The liquid discharging apparatus according to claim 17, wherein the height of the barrier block is a height which prevents the pressure wave from propagating in a region in which the barrier block is arranged.

19. The liquid discharging apparatus according to claim 17, wherein the height of the barrier block is not less than 9/10 of a distance between the two opposite walls.

20. The liquid discharging apparatus according to claim 14, wherein the pressure chamber and the actuator are substantially circular in planes parallel to the two opposite walls of the pressure chamber, and are concentric with each other.

21. The liquid discharging apparatus according to claim 20, wherein the barrier block extends from a sidewall of the pressure chamber toward a center of the pressure chamber linearly in a plane parallel to the two opposite walls.

22. The liquid discharging apparatus according to claim 14, wherein the channel unit further includes: an inlet port through which the liquid flows from the common liquid chamber into the pressure chamber; and an outlet port through which the liquid flows from the pressure chamber toward the nozzle, wherein the barrier block includes a plurality of blocks arranged in a staggered manner with respect to a straight line connecting the inlet and outlet ports.

23. The liquid discharging apparatus according to claim 14, wherein the actuator deforms one of the two opposite walls of the pressure chamber to change a volume of the pressure chamber, and wherein the barrier block is arranged on the other of the two opposite walls.

24. The liquid discharging apparatus according to claim 14, further comprising inlet and outlet ports formed in the pressure chamber.

25. The liquid discharging apparatus according to claim 24, wherein a channel meanders along a straight line connecting the inlet and outlet ports in the pressure chamber.

26. The liquid discharging apparatus according to claim 14, wherein the barrier block creates an annular or meandering channel in the pressure chamber.

27. The liquid discharging apparatus according to claim 14, wherein the actuator is an actuator having a thermal drive mechanism.

28. The liquid discharging apparatus according to claim 14, which is an ink jet printer.

* * * * *